United States Patent [19]

Kono et al.

[11] 4,393,966

[45] Jul. 19, 1983

[54] OPERATION CONTROL APPARATUS OF A COMPRESSOR

[75] Inventors: Hiroya Kono; Jun Hasegawa, both of Kariya; Mitsukane Inagaki, Anjo; Hisao Kobayashi, Kariya, all of Japan

[73] Assignees: Toyoda Jidosha Kogyo Kabushiki Kaisha; Nippon Denso Company Limited, both of Aichi, Japan

[21] Appl. No.: 196,642

[22] Filed: Oct. 14, 1980

[30] Foreign Application Priority Data

Oct. 26, 1979 [JP] Japan ..... 54-138864

[51] Int. Cl.[3] ..... F04B 49/02; F04B 49/06; F16D 43/24

[52] U.S. Cl. ..... 192/56 R; 62/133; 192/103 R; 192/150; 417/42; 417/223; 417/269

[58] Field of Search ..... 192/56 R, 103 R, 104 R, 192/106 R, 150; 62/133, 323.4; 417/42, 223, 269

[56] References Cited

U.S. PATENT DOCUMENTS 2,107,341 2/1938 Peo ..... 192/104 R
2,981,076 4/1961 Gaugler et al. ..... 62/323.4 X
3,121,314 2/1964 Koyanagi ..... 62/133
4,101,249 7/1978 Nakayama et al. ..... 417/269
4,299,543 11/1981 Shibuya ..... 417/269
4,321,991 3/1982 Teijido ..... 192/56 R X

*Primary Examiner*—Rodney H. Bonck
*Attorney, Agent, or Firm*—Browdy and Neimark

[57] ABSTRACT

An operation control apparatus is provided of a compressor having a rotary shaft which is rotated by a driving apparatus by way of a clutch. The operation control apparatus comprises a recess or projection formed in or on one end surface of the rotary shaft as a portion-to-be-sensed offset from the axis thereof, an electromagnetic sensor disposed in facing relation with a locus described by the recess or projection according to the rotation of the rotary shaft, and a pulse monitoring circuit connected to the sensor. The sensor generates a periodic pulse signal in response to rotation of the rotary shaft. The pulse monitoring circuit generates a clutch release commanding signal to the clutch when it receives no pulse signal from the sensor for a predetermined time duration to protect the driving apparatus.

9 Claims, 5 Drawing Figures

OPERATION CONTROL APPARATUS OF A COMPRESSOR

FIELD OF THE INVENTION

This invention relates to an operation control apparatus of a compressor, and more particularly, to an apparatus for suitably or timely disconnecting driving power input with an object of protecting a driving apparatus, i.e., a power source for driving the compressor and relevant instruments and appliances.

BACKGROUND OF THE INVENTION

When a compressor connected drivingly with a driving apparatus fails to operate by chance due to seizure of sliding portions or like troubles, it is liable to consequently damage the driving apparatus because of the overload applied thereto.

In a recent trend wherein the compressor of a vehicle air conditioning system is so designed as to be operated in a common driving system or apparatus, and being driven by power from an engine for driving the car, together with a water pump, an alternator, etc., through a single belt, a possible breakage of the belt due to failure of the compressor may give rise to overheating of the engine, which can lead to serious engine problems.

SUMMARY OF THE INVENTION

This invention stems from such a background. It is, therefore, a primary object of this invention to provide an operation control apparatus which generates a release commanding signal, when the rotation of a rotary shaft of the compressor has been conspicuously decelerated in comparison to the ordinary driving speed or completely halted, to a clutch installed between the compressor and the driving apparatus therefor by immediately sensing the trouble in the rotation of the compressor's shaft.

For attaining this object the operation control apparatus in accordance with this invention is provided with (a) a portion-to-be-sensed disposed on an end surface of the rotary shaft of the compressor and offset in relation to the axis of the rotary shaft, (b) an electromagnetic sensor disposed in opposition to a locus described by the portion-to-be-sensed according to the rotation of the rotary shaft for generating a pulse signal in response to variation of the magnetic flux density which takes place at each passing of the portion-to-be-sensed in the proximity thereof, and (c) a pulse monitoring circuit connected to the electromagnetic sensor for providing the release commanding signal to the clutch, if and when it does not receive the pulse signal from the electromagnetic sensor for a predetermined time duration.

In an operation control apparatus of such a structure the electromagnetic sensor generates cyclic or periodical pulse signals in response to the rotation of the rotary shaft; and an extreme elongation of the interval between such pulse signals, or complete stoppage of the pulse signal generation, will be sensed by the pulse monitoring circuit as an abnormal condition of the compressor for immediately disconnecting the compressor from the driving apparatus. The operation control apparatus has great advantages in protecting the driving apparatus, which consequently prevents serious car accidents occurring when the operation control apparatus is applied to a vehicle air conditioning system. As the electromagnetic sensor can be mounted in a suitable space in a suction chamber or the like in the compressor, without occupying any special additional space, this invention can be realized effectively without enlarging the bulk of the compressor.

It is another object of this invention to achieve the above-mentioned primary object while avoiding complication of the compressor structure and increase in the manufacturing cost of the compressor to the greatest extent.

It is preferred for achieving this object that the sensed portion be a recess such as a drilled bore in an end surface of the rotary shaft; and the electromagnetic sensor preferably consists of a sensor body, a permanent magnet accommodated in the sensor body and a coil wound about the magnet. This sensor body should be mounted in a fitting hole formed in a housing and secured therein by a snap ring of C form.

A compressor to which this invention is most effectively applicable is of the swash-plate type, whose housing consists of a cylinder block in which a plurality of cylinder bores are formed respectively parallel to the rotary shaft, a front housing and a rear housing respectively covering the front and the rear end of the cylinder block, each housing being provided with a suction chamber and a discharge chamber on the internal side thereof. The electromagnetic sensor is installed in the rear housing where the rotary shaft does not pass through the center of the housing.

DETAILED DESCRIPTION OF THE PREFERRED EMBODIMENT

Figure 1:
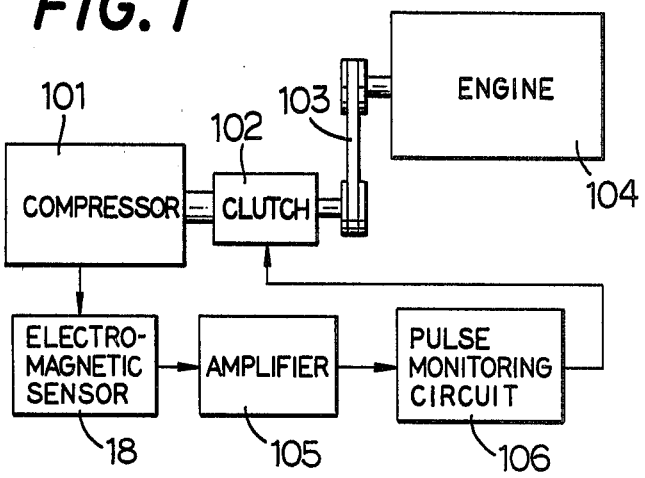
FIG. 1 is a view schematically illustrating an embodiment of an operation control apparatus in accordance with this invention.

FIG. 1 shows how this invention is embodied in a swash-plate type compressor used for vehicle air conditioning, wherein the swash-plate type compressor 101 is connected, via an electromagnetic clutch 102 and a belt transmission mechanism 103, to an internal combustion engine 104 for driving a car.

Figure 2:
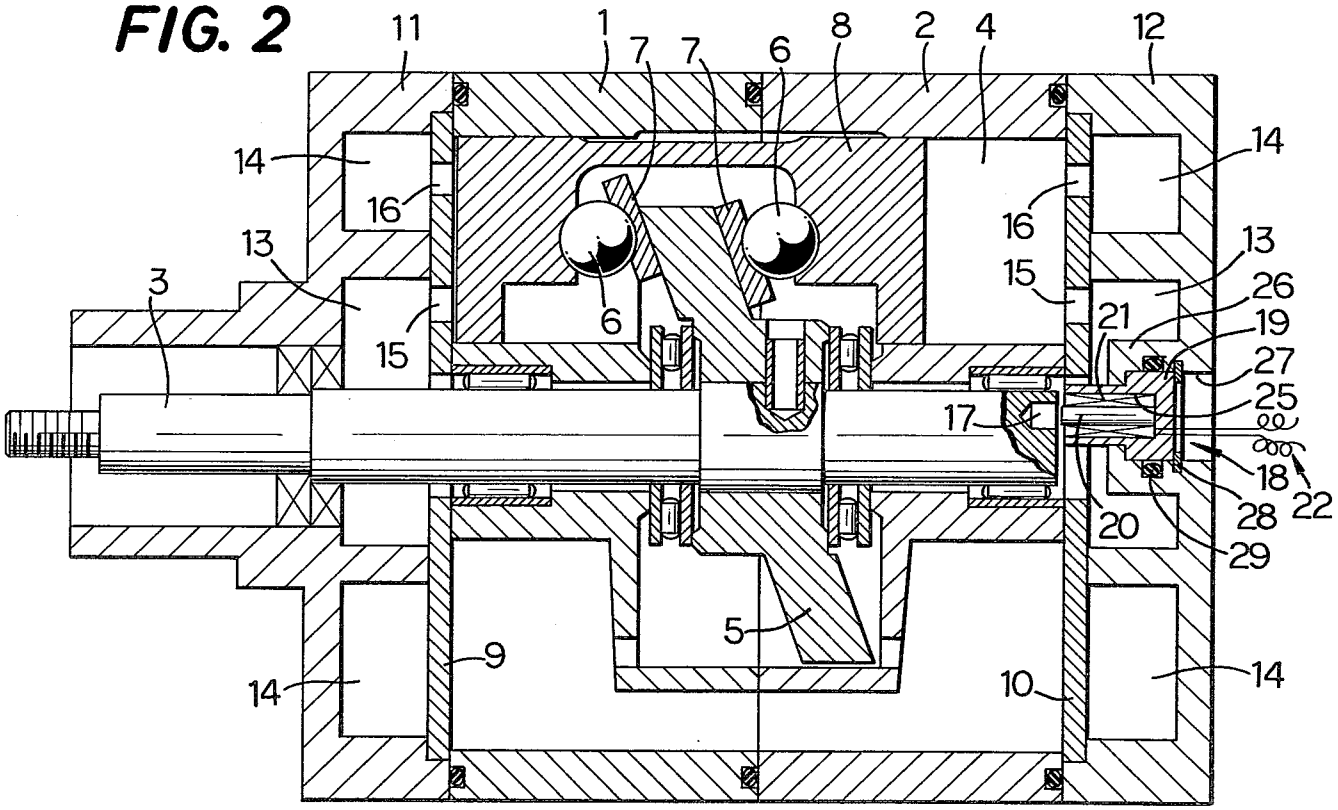
FIG. 2 is an axial section of the compressor shown in FIG. 1.

The swash-plate type compressor 101 is shown in detail in FIG. 2 and has a pair of cylinder blocks 1, 2 fixed to each other face to face. A rotary shaft 3 is disposed extending through the central portion of the pair of cylinder blocks 1, 2, a suitable number of cylinder bores 4 being formed therein parallel to the rotary shaft 3. A swash-plate 5 which is secured on the rotary shaft 3 in a slant posture, engages a plurality of pistons 8 by way of a pair of bearing devices respectively consisting of a ball 6 and a shoe 7. The piston 8 is slidably reciprocated in the cylinder bore 4 by rotation of the swash-plate 5.

Each outer side surface of the cylinder block 1, 2 is respectively fluid-tightly sealed with a front and rear housing 11, 12 via a valve plate 9, 10 sandwiched therebetween. The front and rear housings 11, 12 are provided with a suction chamber 13 and discharge chamber 14 respectively, which not only communicate with an external refrigerating circuit but also with the respective nearby cylinder bore 4, through a suction valve port 15 and a discharge valve port 16 formed in the valve plate 9, 10. The suction valve port 15 and the discharge valve port 16 are respectively provided with a reed valve (although not shown). In the rear end of the rotary shaft 3 is formed a recess 17 as a portion-to-be-sensed which is offset from the axis thereof. In the suction chamber 13 of the rear housing 12 an electromagnetic rotation sensor 18 is disposed oppositely to the rear end surface of the rotary shaft 3. This recess 17 is a drilled bore formed in the end surface of the rotary shaft 3. The electromagnetic rotation sensor 18 is composed of a sensor body 19 made of aluminum or synthetic resins, a permanent magnet 20 retained by the sensor body 19 and a coil 21 wound about the permanent magnet 20. The sensor body 19 is provided with a blind hole 25 formed therein parallel to the axis, and open toward the end surface of the rotary shaft 3. The blind hole 25 accommodates the permanent magnet 20 and the coil 21. The sensor body 19 has stepped external diameters; a small diameter portion adjacent the end surface of said rotary shaft 3 and a large diameter portion remote from said end surface. The sensor body 19 is fitted from outside the rear housing 12 into a stepped hole 27 formed through an inwardly projected portion 26 in the rear housing 12, and it is prevented from being removed by a snap ring 28 of C form fixed on the inside surface of the stepped hole 27. The fluid tightness between the sensor body 19 and the rear housing 12 is maintained by a seal ring 29 fitted in a circumferential groove formed on the inside surface of the stepped hole 27. The front end surface of the permanent magnet 20 is so disposed as to constantly oppose the rotational locus of the recess 17. The coil 21 is connected with a lead wire 22 to a control circuit including an amplifier 105 and a pulse monitoring circuit 106 shown in FIG. 1.

Figure 3:
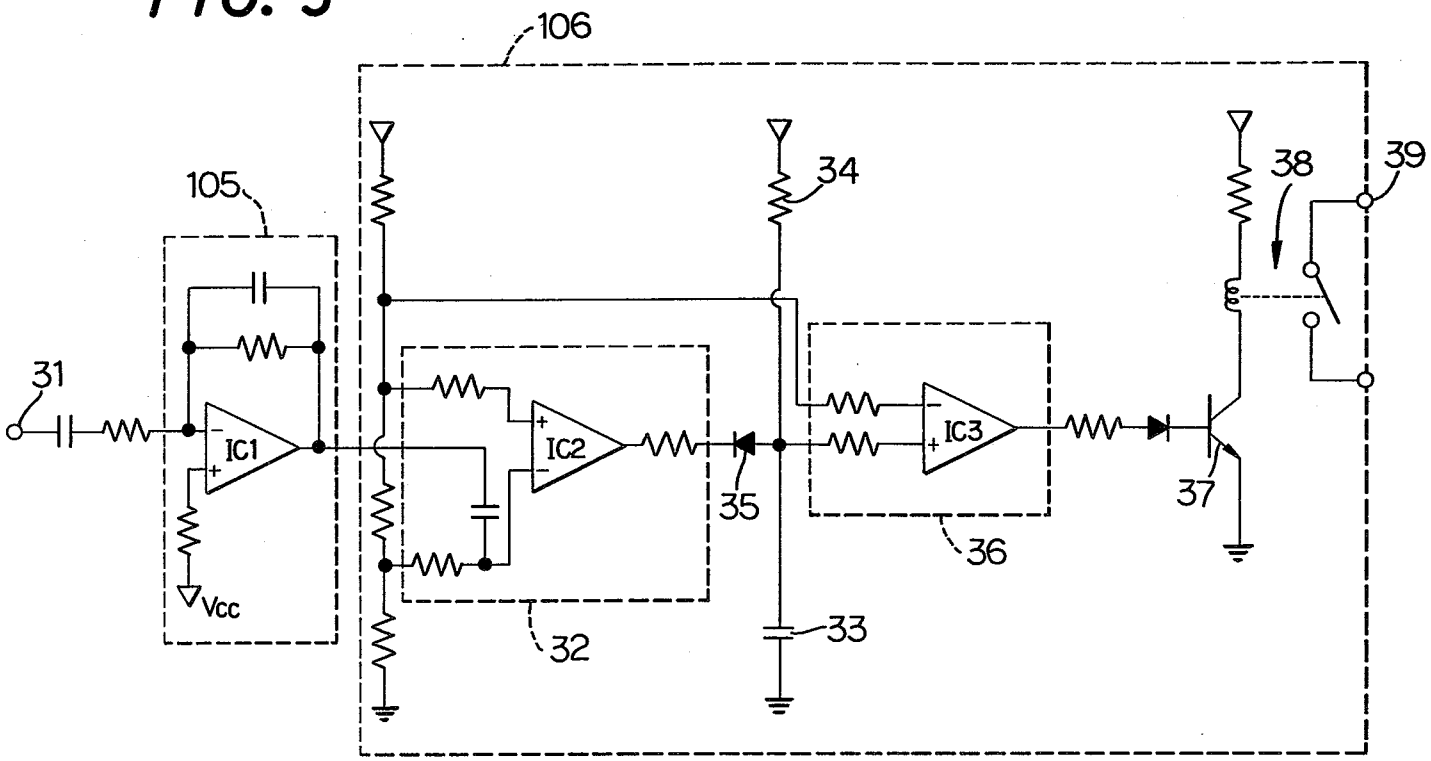
FIG. 3 is an electric circuit diagram of the amplifier and the pulse monitoring circuit shown in FIG. 1.

With reference to FIG. 3 illustrating the amplifier 105 and the pulse monitoring circuit 106, operation of the above-mentioned apparatus will be described hereunder.

Figure 4:
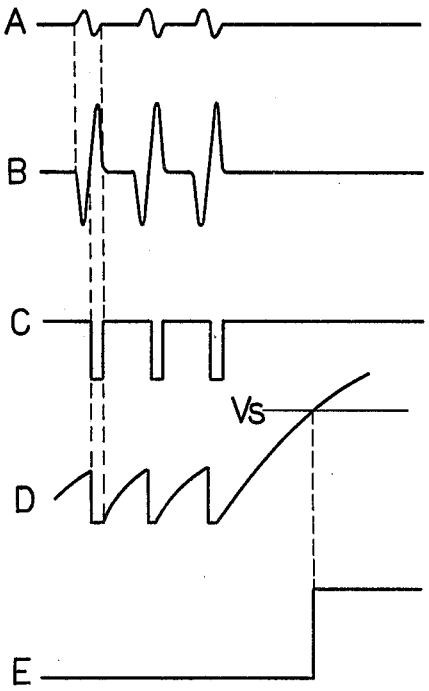
FIG. 4 is a diagram showing wave shapes of signals in the electric circuit shown in FIG. 3.

When the rotary shaft 3, which is connected to the engine 104 via the electromagnetic clutch 102, is rotated the swash plate 5 secured thereto will naturally be rotated so as to reciprocate the piston 8 in the cylinder bore 4 and so compress the gaseous refrigerant of the air conditioning system. At this time the rotation of the rotary shaft 3 moves or rotates the recess 17 formed on the rear end surface thereof along a circular locus. As the density of the magnetic flux formed between the permanent magnet 20 and the metallic rotary shaft 3 is changed every time the recess 17 faces, i.e. passes across the end of the permanent magnet 20, electric current is generated in the coil 21 at each change of the magnetic flux density. Consequently pulses are generated from the coil 21 at a period or interval in response to the rotational speed of the rotary shaft 3. While the compressor is working normally the pulses shown in FIG. 4 by A are, therefore, periodically generated and supplied to an input terminal 31 shown in FIG. 3. This signal will be amplified by the amplifier 105 into the signal shown in FIG. 4 by B. The signal thus amplified will be changed into a signal of rectangular wave form, as shown in FIG. 4 by C, by a comparator 32 and provided to a capacitor 33. The capacitor 33 is charged, while the voltage of the comparator 32 at the output terminal thereof is at high level, via a resistor 34; when the voltage has become low in level the capacitor 33 begins to be discharged via a diode 35. The voltage of the capacitor 33 is varied as shown in FIG. 4 by D. The voltage of the capacitor 33 is provided to the non-inverting input terminal of a comparator 36 and compared with the standard voltage Vs (see FIG. 4) provided to the inverting input terminal.

When the compressor is accidentally stopped due to seizure of the sliding part or parts or damage of some parts, the pulses will not be emitted from the coil 21 of course. So sensing by the pulse monitoring circuit 106 of non-generation of the pulses, for a time duration beyond a predetermined length or interval, will cause generation of a clutch release commanding signal therefrom. In other words, ceasing of generation of pulses from the coil 21 will keep the voltage of the output terminal of the comparator 32 at high level, preventing the discharge of the capacitor 33. It results in making the voltage provided to the non-inverting input terminal of the comparator 36 higher than the standard voltage Vs, as shown in FIG. 4 by D, which changes the output signal from the comparator 36 to high level. A transistor 37 will consequently be turned ON to operate a relay 38. The release commanding signal shown in FIG. 4 by E will be provided from an output terminal 39 to the clutch 102, which causes the compressor 101 to be separated from the engine 104. It will effectively protect the driving apparatus including the engine 104, the belt transmission mechanism 103, etc., and other instruments and appliances. Practically speaking, however, extremely slowed rotational speed of the rotary shaft 3 makes the pulses too low in the level thereof to be sensed, so the above described action takes place immediately before the compressor completely stops.

Figure 5:
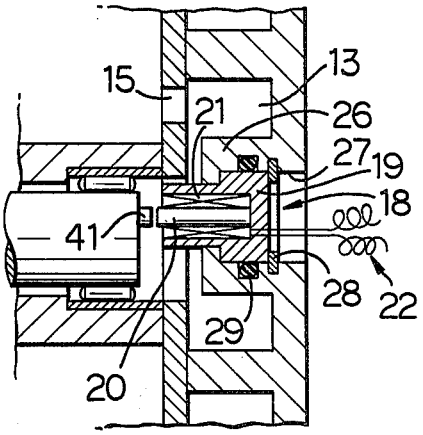
FIG. 5 is a partial axial section of another embodiment of an operation control apparatus in accordance with this invention.

Instead of the recess 17, a projection 41 formed in opposition to the permanent magnet 20, as shown in FIG. 5, will serve the same purpose. This invention can be applied to any type of compressor, so long as it has a rotational drive shaft, and variations and modifications of the inventions may be made within the spirit of the later appended claims.

What is claimed is:

1. An operation control apparatus of a compressor provided with a rotary shaft which is rotated by a driving apparatus by way of a clutch, and a housing for rotatably supporting said rotary shaft, comprising:

a sensed portion disposed on one end surface of said rotary shaft and offset from the axis of said shaft;

an electromagnetic sensor disposed opposite to a locus described by said sensed portion and generating pulse signals in response to variation of the magnetic flux density which takes place every time said sensed portion passes across said electromagnetic sensor during rotation of said rotary shaft; and a pulse monitoring circuit connected to said electromagnetic sensor and providing a release commanding signal to said clutch when it receives no pulse signal from said electromagnetic sensor for a predetermined time duration.

2. An operation control apparatus according to claim 1, wherein said sensed portion is a recess formed in the end surface of said rotary shaft.

3. An operation control apparatus according to claim 1, wherein said sensed portion is a projection projected from the end surface of said rotary shaft.

4. An operation control apparatus according to claim 1, wherein said electromagnetic sensor includes a sensor body secured on said housing of said compressor, a permanent magnet so fixed on said sensor body as to be opposed at one end thereof to said sensed portion, and a coil wound about said permanent magnet.

5. An operation control apparatus according to claim 4, wherein said sensor body is provided with a circular blind hole formed therein parallel to said axis and open toward said end surface of said rotary shaft, said blind hole accommodating said permanent magnet and said coil therein.

6. An operation control apparatus according to claim 5, wherein said sensor body has a larger external diameter at a portion thereof axially remote from said end surface of said rotary shaft than at a portion adjacent said end surface, said housing having a stepped hole formed therein so as to match the external shape of said sensor body, and a snap ring fixed to the inside surface of said stepped hole, said sensor body being securely fitted in said stepped hole and prevented by said snap ring from being removed.

7. An operation control apparatus according to claim 6, wherein said housing has a circumferential groove formed in said inside surface of said stepped hole, and a seal ring is disposed in said groove and maintains gas tightness between said housing and said sensor body.

8. An operation control apparatus according to claim 2, wherein said recess is a drilled bore formed in the end surface of said rotary shaft.

9. An operation control apparatus according to claim 1, wherein said housing includes a cylinder block provided with a plurality of cylinder bores formed parallel to said rotary shaft, a front housing covering the front end surface of said cylinder block and supporting at the central portion thereof said rotary shaft which projects in forward direction therefrom, and a rear housing covering the rear end surface of said cylinder block and the end surface of said rotary shaft, said rear housing including a projecting portion extending from an inside surface thereof toward said rotary shaft, said projecting portion having a throughhole formed parallel to said rotary shaft and securely accommodating said electromagnetic sensor.

* * * * *

UNITED STATES PATENT AND TRADEMARK OFFICE

CERTIFICATE OF CORRECTION

PATENT NO. : 4,393,966

DATED : July 19, 1983

INVENTOR(S) : Kono et al.

It is certified that error appears in the above-identified patent and that said Letters Patent are hereby corrected as shown below:

On the title page Item [73] should read as follows:

-- Kabushiki Kaisha Toyoda Jidoshokki Seisakusho, Toyota Jidosha Kogyo Kabushiki Kaisha, Nippon Denso Company Limited, all of Aichi, Japan --.

Signed and Sealed this

Third Day of April 1984

[SEAL]

Attest:

GERALD J. MOSSINGHOFF

Attesting Officer

Commissioner of Patents and Trademarks